US012247269B2

(12) United States Patent
Han

(10) Patent No.: US 12,247,269 B2
(45) Date of Patent: Mar. 11, 2025

(54) METHOD AND APPARATUS FOR PROCESSING A LIQUID ALLOY

(71) Applicant: Qingyou Han, West Lafayette, IN (US)

(72) Inventor: Qingyou Han, West Lafayette, IN (US)

( * ) Notice: Subject to any disclaimer, the term of this patent is extended or adjusted under 35 U.S.C. 154(b) by 0 days.

(21) Appl. No.: 16/932,068

(22) Filed: Jul. 17, 2020

(65) Prior Publication Data

US 2022/0017993 A1 Jan. 20, 2022

(51) Int. Cl.

| | |
|---|---|
| ***C22C 1/12*** | (2023.01) |
| ***B22D 1/00*** | (2006.01) |
| ***B22D 17/00*** | (2006.01) |
| *B22D 11/00* | (2006.01) |
| *B22D 11/112* | (2006.01) |
| *B22D 11/114* | (2006.01) |
| *B22D 27/08* | (2006.01) |

(52) U.S. Cl.

CPC ..... *C22C 1/12* (2023.01); *B22D 1/00* (2013.01); *B22D 17/007* (2013.01); *B22D 11/003* (2013.01); *B22D 11/112* (2013.01); *B22D 11/114* (2013.01); *B22D 27/08* (2013.01)

(58) Field of Classification Search

CPC ..... C22C 1/12; B22D 1/00; B22D 17/007

See application file for complete search history.

(56) References Cited

U.S. PATENT DOCUMENTS 6,645,323 B2 * 11/2003 Flemings ..... C22B 9/003 164/122
6,681,836 B1 * 1/2004 Sakamoto ..... B22D 17/30 164/133
2017/0080484 A1 * 3/2017 Wannasin ..... B22D 17/007

FOREIGN PATENT DOCUMENTS

EP 841406 A1 * 5/1998 ..... B22D 17/007

* cited by examiner

*Primary Examiner* — Kevin E Yoon
*Assistant Examiner* — Jacky Yuen

(57) ABSTRACT

A method and apparatus for producing solid alloy components from its liquid state are provided. The molten alloy is rapidly cooled using a chill to temperatures below the thermosolutal transition temperature of the alloy. Finite-amplitude acoustic vibration is applied on the chill to shake off dendrites that form on the chill surface, to stir the slurry containing the fragments of dendrites, and to shake off slurry material that sticks on the surface of the chill as the chill is separating from the slurry. The slurry is then immediately poured into a chamber of a forming machine or a mold cavity shaped into solid components.

8 Claims, 5 Drawing Sheets

METHOD AND APPARATUS FOR PROCESSING A LIQUID ALLOY

GRANT STATEMENT

None.

FIELD OF THE INVENTION

The present invention relates to processing of liquid metallic alloy for metal forming, more specifically, to a novel method and apparatus for processing a liquid metallic alloy for die casting or forging of metals and alloys.

BACKGROUND OF THE INVENTION

High pressure die casting (HPDC), or die casting, is a process involving transferring molten metal in a ladle from a holding furnace, pouring molten metal from the ladle into the chamber of the shot sleeve, and injecting the molten metal in the chamber of the shot sleeve into a steel die under high pressure. The metal, either aluminum, magnesium, zinc, or sometimes copper, is held under pressure until it solidifies into a net shape part. This process is capable of producing precision (net-shape) and lightweight products at a rapid production rate and with a high metal yield per mold. No other metal casting processes allow for a greater variety of shapes, fine intricacy of design or closer dimensional tolerance. As a result, the automotive industry has been using this cost effective process for producing large, thin-walled, and lightweight aluminum castings. Still cost reduction is essential in making the HPDC process more competitive compared to other costing technologies.

The casting equipment and the metal dies represent large capital costs. The tooling for the HPDC process is fairly expensive. Increasing tooling life leads to reduced costs for this process. Tooling damage is usually associated with die soldering, and heat checking. The tendencies of die soldering and heat checking increase with increasing temperatures so that tooling life is strongly affected by the pouring temperature of the molten alloy [1-2]. The lower the pouring temperature, the longer the tooling life. Unfortunately, the pouring temperature has to be significantly higher than the liquidus of the alloy. This is because after the molten metal is poured into the steel shot sleeve, the molten metal cools quickly to below the liquidus which causes the formation of primary tree-like crystals called dendrites from the liquid within the massive shot sleeve. Recently, the inventor of the present invention has found that slurry containing these tree-like dendrites can choke the mold filling near the in-gate in the runner/gating system before the dies are completely filled [3], leading to the formation of casting defects such as, misruns, cold shuts, folds, flow marks, and etc. The only way to lower the pouring temperature of the molten metal is to produce a slurry containing non-dendritic crystals. Semi-solid materials having non-dendritic or spherical primary particles are known to be castable at temperatures much lower than the liquidus using the HPDC process [4]. The fraction solid in the semi-solid material during mold filling is in the range of 0.3 to 0.5 with the remainder being the liquid phase [4-5].

Methods for producing semisolid materials are described in U.S. Pat. No. 3,948,650 to Flemings et al. and U.S. Pat. No. 3,954,455 to Flemings et al. As disclosed by these patents, a metal alloy in the semi-solid state can be vigorously agitated to break up dendrites into spherical particles. Slurry made in such a way can then feed into the shot sleeve of a die casting machine to make a casting. The benefits of semisolid materials having non-dendritic, or spherical primary particles include improved mold filling, lower mold erosion, no die soldering, and thus increased die life and shot tooling life. Other advantages of the semisolid process include less shrinkage during solidification, less porosity in the casting, and more uniform mechanical properties. Because of these benefits, several techniques have been developed to produce semisolid material by applying agitation during solidification, including mechanical stirring, electromagnetic stiffing, and ultrasonic vibrations. These techniques utilize different media or means to achieve agitation at the semi-solid state of an alloy. However, a significant portion of the cooling cycle is required to form a high fraction solid while undergoing continuous agitation. The degree of agitation required by this process causes an undesirable entrapment of gases and oxide particles into the high fraction solid. Furthermore, semisolid materials with high fractions of solid can be handled like a solid material. Although the semi-solid material experiences shear-thinning, making it moldable using HPDC or forging process but the semisolid material is not suitable to be cast under gravity. As a result, these techniques are difficult to be used in the ladle to produce non-dendritic or spheroid crystals in a mixture of liquid-solid that can be poured into a shot sleeve for diecasting.

European Patent Application 96108499.3 (Publication No. EP0745 694A1) discloses a process for forming non-dendritic semi-solid material which can be cast. In this process, a molten metal is transferred to an insulating vessel under cooling conditions wherein crystal nuclei are formed in the molten metal. The melt containing these nuclei is then further cooled in the vessel under conditions to allow these nuclei to grow into spheroidal crystals before it is cast. A major problem is that the cooling rate and degree of agitation are poorly controlled such that the crystal nuclei are limited in number and are not homogeneously dispersed in the slurry. Furthermore, a skin is formed on the bottom surface of the solidified product which has to be removed.

U.S. Pat. No. 5,144,998 to Hirai et al., U.S. Pat. No. 5,901,778 to Ichikawa et al., and U.S. Pat. No. 5,865,240 to Asuke disclose processes for forming a castable liquid-solid alloy containing spheroid crystals. These processes involve preparing a molten alloy at a first vessel, transferring the molten metal to a second vessel where it is stirred using a rotor at the semi-solid temperatures, and then transporting the resultant semisolid slurry for casting. Entrapment of gases and oxide particles is an issue for such a process. In addition, these processes require relatively long time durations to form spheroid crystals.

An improved process for making a semisolid composition by casting is described in U.S. Pat. No. 6,645,323 to Flemings et al. The patented process deals with rapidly cooling the molten metal while vigorously agitating it under conditions to avoid entrapment of gases while forming solid nuclei homogeneously distributed in the liquid. Cooling and agitation are achieved by utilizing a cool rotating rod that extends deep into the liquid. Agitation is ceased when the liquid contains a small fraction solid. The solid-liquid mixture is then cast. The patent claims that spheroid crystals can be formed in the molten metal within a few seconds. One of the problems with this process is that the cooling rotating rod for cooling and agitation becomes coated with liquid metal that sticks to the surfaces of the agitator. As a result, the rod/agitator as described in this patent requires frequent cleaning and replacement. U.S. Pat. No. 6,918,427 to Yurko et al. discloses the use of graphite rod/agitator for cooling and agitation so that the metal skin can be easily removed or cleaned. Still, the rotating rod agitator described in these patents tends to form a large vortex in the melt, which inevitably entraps gases and oxide particles into the molten metal. Because of vortex formation, the processes described by these patents cannot be used for processing molten metal in a small or large but shallow vessel containing the liquid metal, such as the ladle typically used during the HPDC process.

High intensity ultrasonic vibration has been demonstrated of being capable of producing non-dendritic spheroid crystals during the solidification process of an alloy [6-9]. Much of the work in this area either applies ultrasonic vibration to the vessel holding the molten alloy or uses an ultrasonic probe/radiator that submerges deep into the molten alloy for producing non-dendritic primary crystals in the liquid-solid mixture. The idea is to use high-intensity ultrasonic vibrations to create cavitation conditions under which nucleation of the primary solid phase is encouraged [10], and phenomena such as acoustic streaming and acoustic pressure are generated to break up dendrites into globular fragments [11]. The problem with these approaches is that the intensity of ultrasonic vibration at the tip of the ultrasonic probe has to be high enough to generate cavitation conditions. Since the power of the ultrasonic vibration is limited, the size of the acoustic probe has to be small so that the surface area at the acoustic tip is small enough to ensure the power density there is high enough. The power density is defined as the acoustic power divided by the surface area at the acoustic tip. As a result, globular crystal formation has been achieved only in small ingots [6-11], which is too small for industrial applications.

U.S. Pat. No. 7,621,315 to Han et al. discloses a method forming non-dendritic spheroid crystals in a container coupled with high-intensity ultrasonic vibration. The method makes semi-solid castings directly from molten alloys using the steps of vibrating a molten material at an ultrasonic frequency while cooling the material to a semi-solid state, and forming the semi-solid material into a desired shape. The issue with this patented technology is that the ultrasonic vibration is coupled to the bottom of the molten metal. It is difficult to use such a device to scoop the molten metal from the holding furnace and then pour the treated molten metal into the shot sleeve. Furthermore, it is difficult to pour liquid metal out of the container since there is little control of temperature and cooling rate of the molten metal.

Therefore, there is a need to develop a clean and efficient method and apparatus for producing non-dendritic or spheroid crystals in a solid-liquid mixture in a vessel which can be used to scoop molten metal from the holding furnace and pour the solid-liquid mixture into a shot sleeve for HPDC processing. Such a method and apparatus can be directly incorporated into the existing HPDC process or liquid forging process for making high quality castings or forgings with much reduced costs.

SUMMARY OF THE INVENTION

The present invention relates to a method and apparatus for producing a solid-liquid mixture of an alloy containing a small fraction of non-dendritic primary phase solid particles in a ladle which can be poured into a shot chamber during HPDC or forging process to make solid components. In this method, the ladle is used to scoop a desired amount of molten metal alloy from a melt holding vessel. The molten alloy in the ladle is then contacted with a solid metal chill at the chill-melt interface for a few seconds to create a sub-liquidus region in the liquid near the interface on which dendrites of the primary solid phase precipitate from the molten alloy. Small amplitude vibration is coupled to the chill to shake off these dendrites formed on the chill-liquid interface and to shake off the liquid metal that may stick to the solid chill as it is separated from the solid-liquid mixture. The mixture of solid and liquid containing a small fraction of non-dendritic primary phase solid particles is then poured into the shot sleeve and injected into dies for the production of solid components.

In another embodiment, the invention relates to a method and apparatus for producing a solid-liquid mixture of an alloy containing a small fraction of non-dendritic primary phase solid particles in a ladle, where the first vessel containing the molten metal is a holding furnace and the second vessel is a ladle used for the HPDC process. The method involves scooping molten metal using the second vessel from the first vessel and contacting the molten metal in the second vessel for a few seconds with a chill coupled with small amplitude vibrations. A slurry containing a small fraction of dendrite fragments is formed in the second vessel and poured into a third vessel, the shot sleeve, at temperatures lower than the usual pour temperatures for the same alloy using conventional HPDC process, leading to increased die and shot tooling life. Non-dendritic primary solid particles are formed in the second vessel and grow in the third vessel. The slurry containing non-dendritic solid particles is injected into molds to form solid components.

In another embodiment, the invention relates to a method and apparatus for producing a solid-liquid mixture of an alloy containing a small fraction of non-dendritic primary phase solid particles in a ladle using a solid chill, where the chill is a solid article made of material of high thermal conductivity and high thermal fatigue resistance. The amount of heat extracted from the molten alloy is controlled by contacting the molten alloy with the chill for a predetermined duration based on the initial temperatures of the molten alloy and the chill, their sizes, and their physical properties. A region with sub-liquidus temperatures is created near the chill-melt interface to allow dendrites to nucleate and form on the interface. The temperature at the remaining portion of the molten alloy away from the chill is controlled to be below a critical temperature at which the small fragments can survive their dissolution into the melt and smooth out into ellipsoidal or even spheroid shapes due to the combined effect of dissolution and Oswald ripening. The slurry containing a small fraction of ellipsoidal or spherical particles has much improved castability under HPDC conditions [3-5].

In another embodiment, the invention relates to a method and apparatus for producing a solid-liquid mixture of an alloy containing a small fraction of non-dendritic primary phase solid particles in a ladle using a solid chill. Small amplitude vibration is coupled to the chill to shake off the dendrites and drive them to the portion of the melt with higher temperatures where fragmentation of dendrites occurs. The small amplitude acoustic vibrations are also capable of stiffing the molten metal to enhance the formation of globular fragments while keeping the melt surface quiescent so that the protective oxide film on the melt surface is not disturbed. Furthermore, the vibration shakes off the residual liquid metal that sticks on the chill surface as the chill is separated from the slurry, avoiding freezing or deposition of the molten alloy on the surface which is difficult to be removed or cleaned. Such slurry prepared using this invention is much cleaner than that produced by using a rotating stirrer.

In another embodiment, the invention relates to a method and apparatus for producing a solid-liquid mixture of an alloy containing a small fraction of non-dendritic primary phase solid particles in a ladle using a solid chill, where a large number of small dendrite fragments are created in the slurry in the ladle by the acoustically coupled chill. The existence of such a large number of fragments prevents new dendrites from formation after the slurry is poured into a massive shot sleeve where cooling of the slurry is much rapidly. Vigorous convection in the slurry during the pouring and the subsequent pushing by the ram in the shot sleeve further smoothes out the dendritic fragments and improves the castability of the slurry, which is beneficial in extending die and shot tooling life, and reducing porosity formation in the final casting or forging components.

Various objects and advantages of this invention will become apparent to those skilled in the art from the following detailed description of the preferred embodiments, when read in light of the accompanying drawings, specification, and claims.

DETAILED DESCRIPTION OF THE INVENTION

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

The present invention provides a method and apparatus for producing a solid-liquid mixture of an alloy containing a small fraction of discrete, non-dendritic primary solid phase particles in a ladle which can be poured into a shot chamber during HPDC or forging process for making solid components. The major solid phase that first precipitates from the molten alloy is termed the primary phase. In aluminum alloys, the primary phase is the aluminum-rich fcc phase which grows into dendrites or tree-like particles on cooling of the molten alloy below its liquidus. These dendrites can be broken up into non-dendritic fragments by vigorous stiffing, re-heating or isothermal coarsening in semi-solid temperatures [4-5]. Non-dendritic fragments are usually discrete ellipsoidal- or spherical-shaped particles.

Figure 1:
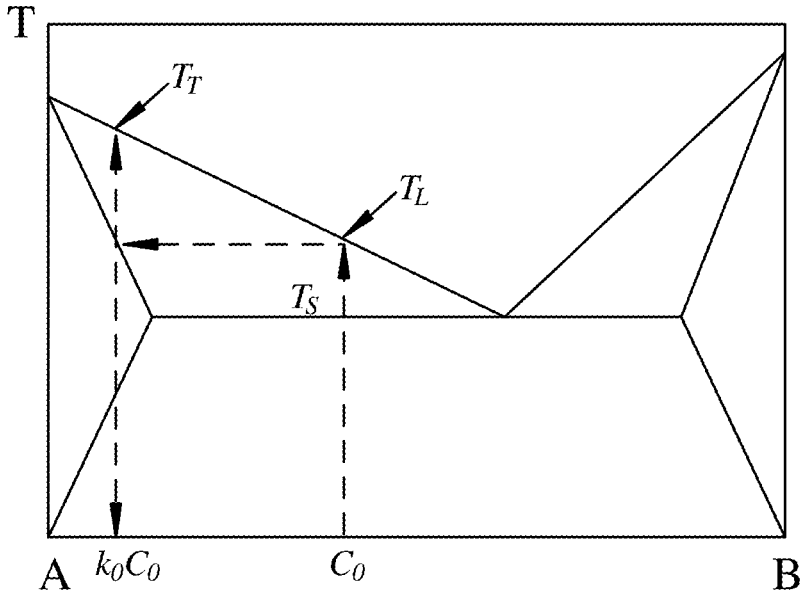
FIG. 1 is a binary phase diagram showing the liquidus, solidus, and the thermosolutal transition temperature for an alloy at a given bulk concentration.

The present invention is made based on the inventor's understanding on the rate of remelting and dissolution of a primary phase solid particle in the molten alloy at various temperatures. FIG. 1 illustrates a binary phase diagram containing elements A and B. On cooling from liquid, an A matrix alloy containing element B with a composition of $C_0$ starts forming the primary solid phase dendrites with its composition of $k_0C_0$ at or slightly below the liquidus, $T_L$, where $k_0$ is the partition coefficient of the element B at the solid-liquid interface, or dendrite-liquid interface during freezing. Equilibrium solidification, i.e., solidification under extremely slow cooling rates, of the alloy completes at the solidus, $T_S$, which is the eutectic temperature on the phase diagram. Consider the dendrites that precipitate near the liquidus temperature, $T_L$. Their composition is $k_0C_0$ and the corresponding liquidus temperature is $T_T$. These dendrites are relatively stable, except coarsening, at temperatures below $T_L$ but will either dissolve back into the liquid or melt when the local temperature are higher than $T_L$.

Dissolution, melting, or isothermal coarsening of dendrites leads to smoothing out dendrites into non-dendritic fragments. However, the former two phenomena result in the disappearance of the fragments in the melt. Still, any residual of each fragment can serve as a nucleus for a new dendrite to grow from the liquid as soon as the local temperature is reduced to below $T_L$. Enough number of such residual particles prevents new solid particles from growing into dendrites, which is effective in forming non-dendritic solid particles from the molten alloy. The issue is how long these fragments will survive before they fully totally disappear in the liquid at temperatures higher than $T_L$. Research has suggested that $T_T$ is actually a thermosolutal transition temperature above which the particles of composition $k_0C_0$ melt and below which these particles dissolve. The melting process is controlled by heat transfer to the particle from adjacent liquid and the dissolution process is controlled by diffusion of element B between the particle and the liquid. Since the thermal diffusivity is a few orders of magnitude higher than the diffusion coefficient of a solute element, the rate of melting is much faster than the rate of dissolution [12-13]. Experimental data also suggest that at temperatures slightly below $T_T$, the dissolution rate of a solid particle is in the order of a few micron meters per seconds. The dissolution rate decreases with decreasing temperature. Thus, it will take over 10 seconds for a particle large than 50 micron meters to dissolve into the melt at temperatures below $T_T$ [12-13]. Such a survival time is long enough for the dendrite to be broken into multiple non-dendritic fragments before cooling under the liquidus temperature of the alloy by using a proper size chill to enhance the cooling of the melt.

The process of the present invention comprises of a first step of forming a liquid alloy with a vessel at prescribed temperatures at a minimum amount of superheat to reduce the use of energy for heating up the alloy and to shorten the production cycle. The vessel is usually a melting or holding furnace. The minimum temperature in this vessel can be as low as the liquidus of the alloy but is usually higher to account for temperature fluctuation which may lead to the growth of solid in the molten alloy.

Figure 2:
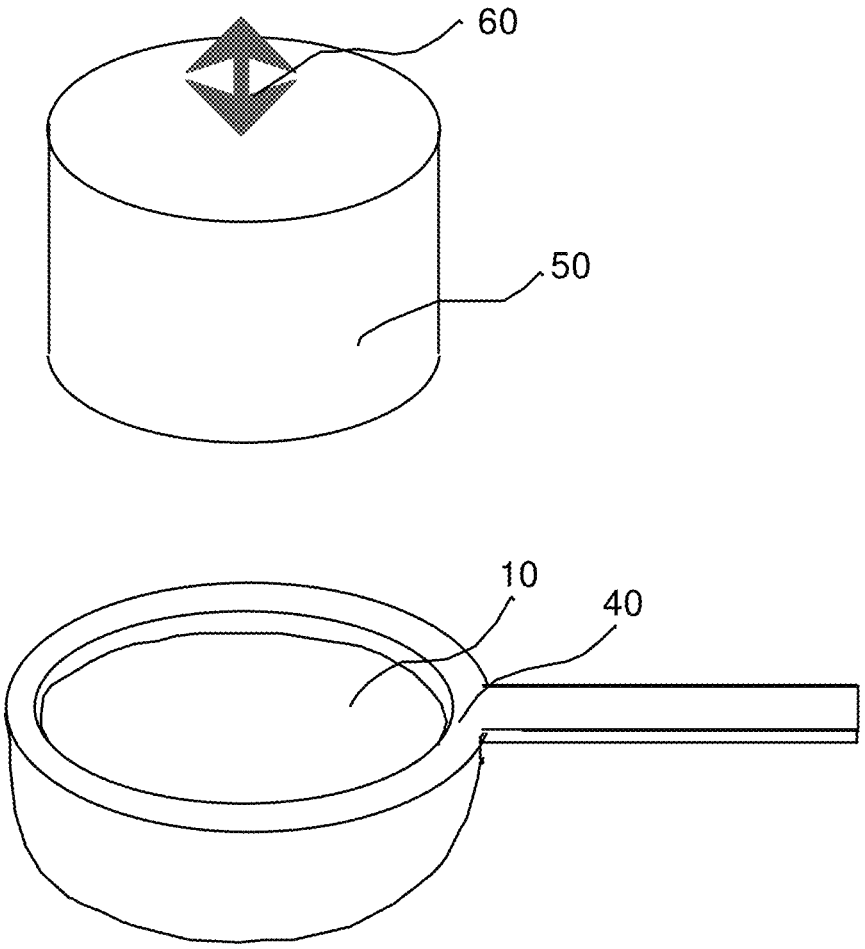
FIG. 2 is a schematic illustration of an apparatus in accordance with an embodiment of the present invention.

The process of the present invention comprises of a second step of transferring the molten alloy 10 prepared in the first step into a second vessel 40, shown in FIG. 2. The second vessel 40 is usually a ladle used in the HPDC process but can also be a trough or other means of holding molten metal before pouring the molten metal for making castings. In the meantime, a chill 50 coupled with vibrators for vibration 60 is prepared. The chill 50 is made of a solid material and is maintained at prescribed temperatures to keep it dry, free from moisture, using internal or external thermal control if needed. The coupling of vibration 60 to the chill 50 can take place in many ways. It can be a plurality of metal sonotrode, or a plurality of sonotrodes surrounded by a metal chill, having a total mass large enough to cool the melt 10 in the vessel 40. It can also be a single block of metal connected to a vibrator or a hollow block of metal with vibration coupled in the hollow block with a fluid serving both as the coupling liquid and as a coolant.

Figure 3:
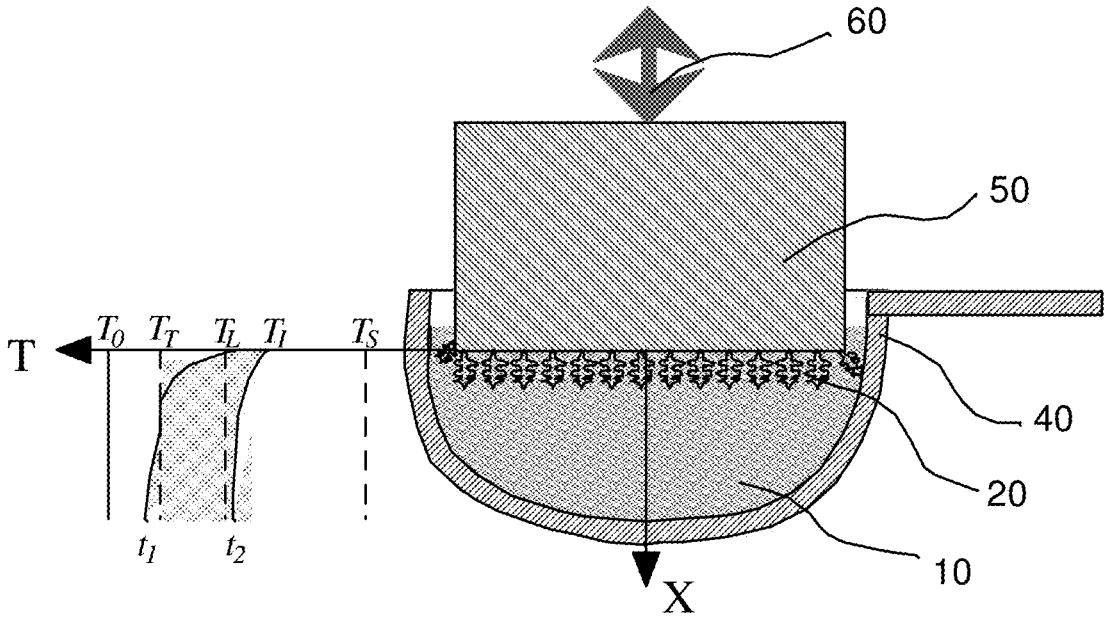
FIG. 3 is a schematic illustration of another embodiment in accordance with the present invention.
Figure 4:
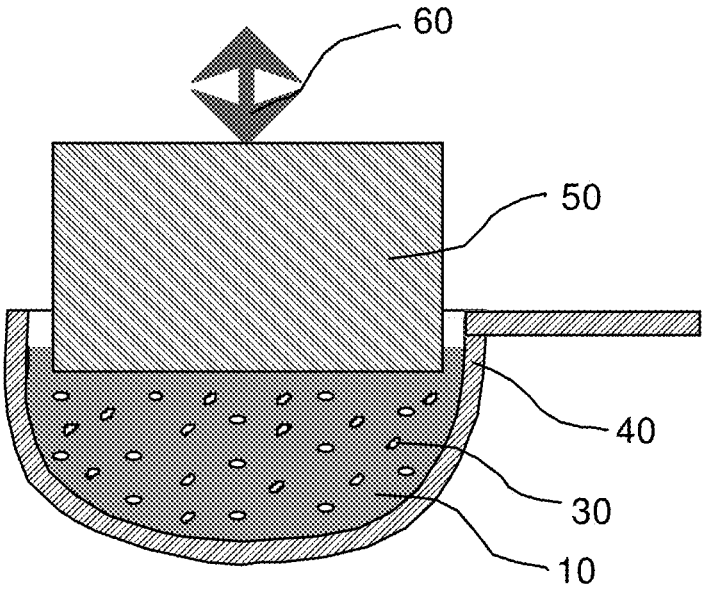
FIG. 4 is a schematic illustration of another embodiment in accordance with the present invention.

The process of the present invention comprises of a third step of cooling and stiffing the molten metal 10 using a vibration 60 coupled chill 50 shown in FIG. 3 to form dendrites 20 on the chill-melt interface and to detach these dendrites 20 shown in FIG. 2 to form non-dendritic fragment 30 using the vibration 60 shown in FIG. 4. The duration of this step lasts for just a few seconds to create fragments 30 in the molten alloy 10 which becomes a mixture of solids and liquids containing a small fraction of non-dendritic solid phase particles. After enough fragments 30 have been made, the chill 50 is separated from the mixture while the vibration 60 shakes off residual liquid that may adhere on the surface of the chill 50. The chill 50 coupled with vibration 60 can also be used in a trough to create fragments of dendrites for casting processes other than the HPDC process.

Figure 5:
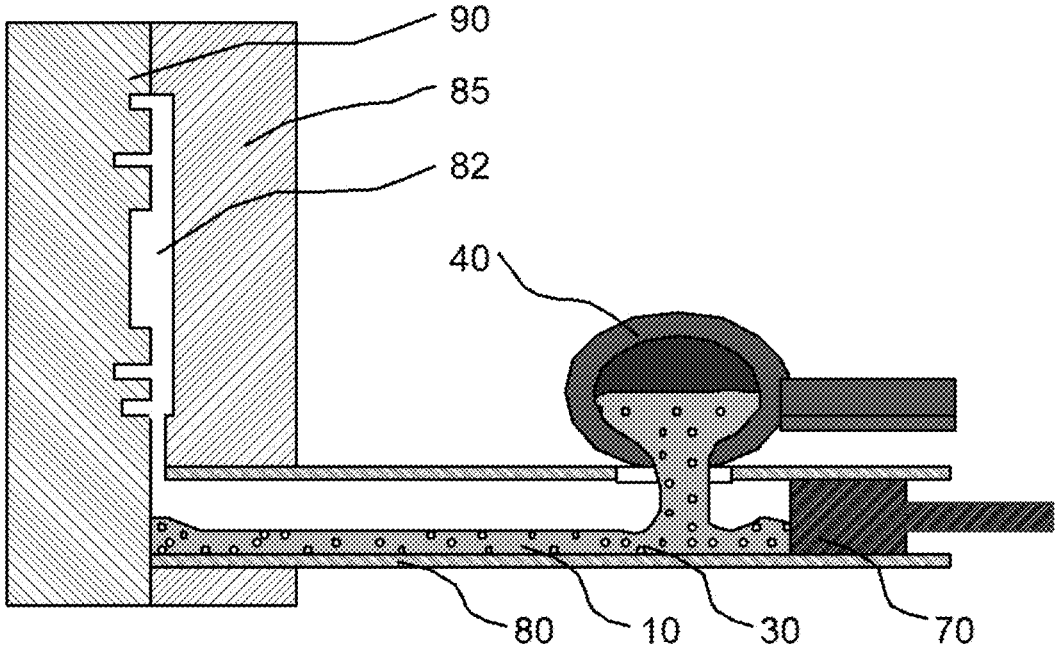
FIG. 5 is a schematic illustration of yet another embodiment in accordance with the present invention.

The process of this invention comprises of a fourth step of pouring the mixture of solid-liquid containing a small fraction of non-dendritic fragments 30 from the vessel 40 into a shot chamber 80 wherein a ram 70 is used to push the mixture 10 into the cavity 82 in dies 85 and 90 to be solidified into a solid component, shown in FIG. 5. The mixture of the solid-liquid containing a small fraction of solid can also be poured into the cavity of casting molds for making components.

The physics associated with the present invention is illustrated in FIG. 3 where the temperatures vs. distance profiles are depicted. The temperature in the molten alloy prior to contacting the chill 50 is $T_0$, which is higher than the liquidus, $T_L$, of the alloy. At the moment when the chill 50 contacts the molten alloy 10, the temperature of the melt 10 at the chill-melt interface is $T_1$, which is much lower than the liquidus, $T_L$, of the alloy. As a result, dendrites 20 form on the chill-melt interface on the wall of the chill 50. In the meantime, the bulk temperature of the molten alloy 10 decreases due to heat extraction by the chill 50. Vibration 60 applied on the chill 50 ensures that dendrites 20 formed on the chill 50 are detached off the wall of the chill 50. The detached dendrites enter the bulk molten metal 10 where they are broken up into fragments 30 due to increased local temperature and vigorous stiffing caused by the vibration 60, shown in FIG. 4. The breaking up of detached dendrites leads to a multiplication in the number of solid phase crystals because each dendrite 20 can be broken into many fragments 30 and each fragment 30 is an individual crystal. The step shown in FIGS. 3 and 4 is maintained for a few seconds. During this step, the temperature profile drops from $T_0$ to that corresponding to time $t_1$, or $t_2$ as the duration increases, shown in FIG. 3. The optimal temperature profile is preferably in the shaded range defined by the curves corresponding to $t_1$ and $t_2$. With the temperature profile at duration of $t_1$, majority of the molten alloy is in the temperatures below the thermosolutal transition temperature, $T_T$, allowing for most of the dendritic fragments 30 to survive for many seconds while experiencing morphological smoothing out. At the temperature profile associated with the duration of $t_2$, the melt 10 is at sub-liquidus temperatures so that all dendritic fragments 30 can survive while experiencing Oswald Ripening. Further vigorous stiffing of the mixture makes the non-dendritic fragments 30 more ellipsoidal or even spherical. The existence of enough non-dendritic fragments 40, shown in FIG. 5 in the shot sleeve 80, makes the local formation of new dendrites impossible so that the cooling and stiffing in the shot sleeve 80 only make the non-dendritic fragments 30 grow while coarsening.

The invention teaches that the temperature in molten alloy in the first vessel, which can be a holding furnace or a melting furnace, has to be higher than the liquidus of the alloy in the first step of the present invention. This is to ensure that no solid alloy particles are formed from the melt in the first vessel because these particles tend to coarse in the vessel holding the alloy at extended times.

The invention also teaches that the surface area of the chill that is in contact with the molten alloy in the second vessel, which is but not limited to the ladle, should be comparable in size to that of the molten metal such that enough dendrites can be produced at the chill-melt interface. The cooling capability of the chill needs to be designed such that 1) the temperature in the melt at the chill-melt interface is below the liquidus of the alloy during the chill cooling process to encourage the nucleation of dendrites on the chill wall, and 2) the bulk temperature of the melt is reduced to below the thermosolutual transition temperature, $T_T$, towards the end of each chill cooling to ensure that majority of the fragments survives before the mixture of the solid-liquid is poured into a shot chamber, a trough to a mold, or a mold cavity for making castings. Such a cooling capability of the chill can be designed using its volume of the chill, internal cooling in the chill, or external cooling on the chill surface. Internal or external cooling may also need to restore the initial designed temperature of the chill before it is used for the next cycle for process a melt in the ladle.

The present invention further teaches that vibration needs to be coupled to the chill to shake off the dendrites on the chill surface, to stir the melt, and to shake off the residual liquid that may stick to the chill surface as it is separated from the melt. For these purposes, any kind of mechanical vibration can be used. The intensity of vibration, defined as power per unit surface area on the chill surface, does not need to be as high as those technologies using high-intensity ultrasonic vibration for grain refining or for making semi-solid materials [6-11]. Small amplitude vibration is preferred as such kind of vibration is unlikely to cause damage (rapture) to the top surface of the melt in the second vessel. For aluminum alloys, for example, the top surface of the melt is covered by a protective layer of oxides. Damage to this layer of oxides leads to pollution to the molten alloy, such as hydrogen absorption and increased oxide formation.

The invention further provides examples of producing a solid-liquid mixture of an alloy containing a small fraction of non-dendritic primary phase solid particles in a ladle which can be poured into a shot chamber during HPDC or forging process for making solid components. The examples provided below are meant merely to exemplify several embodiments, and should not be interpreted as limiting the scope of the claims, which are delimited only by the specification.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. Q. Han, and S. Viswanathan, "Analysis of the Mechanism of Die Soldering in Aluminum Die Casting," *Metallurgical and Materials Transactions A,* vol. 34, 2006, pp. 139-146.

2. Q. Han, "Mechanism of Die Soldering during Aluminum Die Casting," *China Foundry,* vol. 12 (2), 2015, pp. 136-143.

3. Q. Han, and J. Zhang, "Fluidity of Alloys under High Pressure Diecasting Conditions—Flow Choking Mechanisms," *Metallurgical and Materials Transactions B,* vol. 51, 2020, to be published.

4. M. C. Flemings, "Behavior of Metal Alloys in the Semisolid State," *Metallurgical Transaction B,* vol. 22, 1991, pp.269-293.

5. Q. Han, and S. Viswanathan, "The Use of Thermodynamic Simulation for the Selection of Hypoeutectic Aluminum-Silicon Alloys for Semi-Solid Metal Processing," *Materials Science and Engineering A,* vol. 364, 2004, pp. 48-54.

6. X. Jian, H. Xu, T. T. Meek, and Q. Han, "Effect of Power Ultrasound on Solidification of Aluminum A356 Alloy," *Materials Letters, vol.* 59 (2-3), pp. 190-193.

7. O. V. Abramov, *High-Intensity Ultrasonics,* Gordon & Breach Science Publishers, Amsterdam, The Netherlands, 1998, pp. 515-523.

8. G. I. Eskin, *Ultrasonic Treatment of Light Alloy Melts,* Gordon & Breach Science Publishers, Amsterdam, The Netherlands, 1998, pp. 88-90.

9. Q. Han, "Ultrasonic Processing of Materials," *Metallurgical and Materials Transactions B,* vol. 46 (4), 2015, pp. 3975-3979.

10. J. D. Hunt, and K. A. Jackson, "Nucleation of Solid in an Undercooled Liquid by Cavitation," *Journal of Applied Physics,* vol. 31, 1966, pp. 254-257.

11. J. Mi, D. Tan, and T. L. Lee, "In Situ Synchrotron X-Ray Study of Ultrasound Cavitation and Its Effect on Solidification Microstructure," *Metallurgical and Materials Transactions B,* vol. 46B, 2015, pp. 1615-1619.

12. Q. Han, and A. Hellawell, "Primary Particle Melting Rates and Equiaxed Grain Nucleation," *Metallurgical and Materials Transactions B,* vol. 28B, 1997, pp. 169-173.

13. X. Wan, Q. Han, and J.D. Hunt, "A Diffusion Solution for the Melting/dissolution of a Solid at Constant Temperature and Its Use for Measuring the Diffusion Coefficient in Liquids," *Metallurgical and Materials Transaction A,* vol. 29A, 1998, pp. 751-755.

What is claimed is:

1. A method of producing a metallic component from its liquid alloy, comprising:

preparing a liquid alloy that is free from its primary solid phase material and transferring a predetermined quantity of liquid alloy to a holding vessel or a trough;

preparing a vibration coupled block chill having a bottom surface with a shape and size complementary to that of the liquid alloy;

contacting a top surface of the liquid alloy with the vibration coupled chill to form solid crystals on chill-liquid interfaces, and to rapidly cool bulk of the liquid alloy to below its thermosolutal transition temperature;

maintaining the bottom surface of the chill in a substantial contact with the top surface of the liquid alloy;

vibrating the chill to shake off the solid crystals formed on the chill-liquid interfaces, to drive them to the bulk of the liquid alloy, and to cause forced convection to mix the solid crystals with the bulk of the liquid alloy to form a slurry containing a small fraction of non-dendritic solid crystals while the top surface of the liquid alloy remains quiescent;

separating the chill from the slurry after the solid content in the slurry has risen to about 1% to 20% while vibrating the chill to shake off the slurry that may stick to surfaces of the chill; and pouring the slurry containing the small fraction of non-dendritic solid crystals into a component forming apparatus and shaping the slurry into a desired solid component.

2. The method of claim 1, wherein the liquid alloy is maintained at minimum superheat within 80° C. above its liquidus temperature.

3. The method of claim 1, wherein the liquid alloy is a metallic alloy including an aluminum alloy at temperatures above its liquidus temperature.

4. The method of claim 1, wherein the liquid alloy is a magnesium alloy at temperatures above its liquidus temperature.

5. The method of claim 1, wherein the liquid alloy is a zinc alloy at temperatures above its liquidus temperature.

6. The method of claim 1, wherein the liquid alloy is rapidly cooled, using the chill comprising a metallic material, to below the thermosolutal transition temperatures of the alloy in order to produce a large number of non-dendritic fragments and to maintain these fragments in the slurry containing a small fraction of solid in the range of about 1% to 20%.

7. The method of claim 1, wherein finite-amplitude vibration is coupled to the chill to shake off dendrites and to stir the bulk of the liquid alloy while maintaining the top surface of the liquid alloy quiescent.

8. The method of claim 1, wherein the chill is cooled internally or externally to enhance its cooling capability and to maintain its desired temperatures using a fluid including compressed air, water, cooling oil, ionic liquid, or liquid metallic alloy.

* * * * *